US005804791A

United States Patent [19]

Gelus

[11] Patent Number: 5,804,791

[45] Date of Patent: Sep. 8, 1998

[54] HEATING ELEMENT HAVING A SANDWICH STRUCTURE AND ELECTRIC HOME APPLIANCE OF THE TYPE OF STEAM PRESSING IRON CONTAINING SUCH AN ELEMENT

[75] Inventor: Dominique Gelus, Eyzin-Pinet, France

[73] Assignee: SEB S.A., Selongey, France

[21] Appl. No.: 8,101

[22] Filed: Jan. 25, 1993

[30] Foreign Application Priority Data

Jan. 24, 1992 [FR] France ..... 92 00970

[51] Int. Cl.[6] ..... H05B 3/18; D06F 75/24

[52] U.S. Cl. ..... 219/245; 219/254; 219/544; 219/542; 338/254; 38/77.1; 29/611

[58] Field of Search ..... 219/245, 254, 219/255, 544, 542, 540, 522, 203, 505, 457, 462, 463; 338/254, 255, 275, 306; 392/432, 435; 38/77.1; 29/611

[56] References Cited

U.S. PATENT DOCUMENTS

| | | | |
|---|---|---|---|
| 447,023 | 2/1891 | Carpenter | 219/540 |
| 457,828 | 8/1891 | Morford | 338/254 |
| 566,693 | 8/1896 | Leonard | 338/254 |
| 1,149,172 | 8/1915 | Ball | 219/245 |
| 1,287,192 | 12/1918 | Berry | 219/544 |
| 1,472,185 | 10/1923 | Mollenhauer | 219/544 |
| 1,930,880 | 10/1933 | Lokke | 219/544 |
| 2,569,499 | 10/1951 | Shoub | 338/254 |
| 2,889,439 | 6/1959 | Musgrave | 219/544 |
| 3,191,004 | 6/1965 | Hocker | 219/544 |
| 4,860,434 | 8/1989 | Lovison et al. . | |
| 5,100,494 | 3/1992 | Schmidt | 156/344 |

FOREIGN PATENT DOCUMENTS

| | | | |
|---|---|---|---|
| 0201967 | 11/1986 | European Pat. Off. . | |
| 822661 | 1/1938 | France | 392/435 |
| 2048252 | 3/1971 | France . | |
| 0331565 | 9/1989 | France . | |
| 2641291 | 3/1991 | France . | |
| 1299089 | 7/1969 | Germany . | |
| 2615064 | 10/1977 | Germany . | |
| 3530690 | 3/1987 | Germany | 392/435 |
| 503299 | 3/1939 | United Kingdom | 219/254 |
| 1085784 | 10/1967 | United Kingdom . | |
| 1102125 | 2/1968 | United Kingdom . | |
| 1102126 | 2/1968 | United Kingdom | 219/254 |

OTHER PUBLICATIONS

Neuew aus der Technik; Nummer 4 vom 15. Dec. 1989, Seite 5.

*Primary Examiner*—John A. Jeffery
*Attorney, Agent, or Firm*—Loeb & Loeb LLP

[57] ABSTRACT

A heating structure for use in an appliance, the heating structure being a sandwich structure composed of two rigid elements constituting external elements of the sandwich structure, with at least one of the rigid elements being a heating plate; a heating unit composed of an electrical resistance component disposed between the rigid elements for producing heat which is diffused through the rigid elements, and electrical insulation material covering the electrical resistance component; and bonding layers securing the heating unit to the rigid elements. The heating unit further includes a primary layer of thermoplastic resin material into which the electrical resistance component is inserted, the electrical insulation material is composed of first and second layers of electrical insulation material which enclose the electrical resistance component, and the primary layer of thermoplastic resin material adheres to the layers of electrical insulation material. The bonding layers include a second layer of thermoplastic resin material disposed between, and adhering to, the heating plate and the first layer of electrical insulation material.

17 Claims, 4 Drawing Sheets

HEATING ELEMENT HAVING A SANDWICH STRUCTURE AND ELECTRIC HOME APPLIANCE OF THE TYPE OF STEAM PRESSING IRON CONTAINING SUCH AN ELEMENT

BACKGROUND OF THE INVENTION

The present invention relates to the field of flat heating structures of the sandwich type, intended to perform at least two differentiated thermal functions.

The present invention relates more specifically to a sandwich heating structure which is delimited at the exterior by two elements having a certain rigidity. At least one of these elements is a heating plate adapted to diffuse the heat produced by a resistive component extending between the two elements. Such a structure is thus capable of supplying heat which can be differentiated by the two elements in the case of utilization of two heating plates to assure distinct thermal functions such as heating and vaporization, or simply heat dissipation.

The invention is applicable particularly, but not exclusively, to electrical home appliances and, among these, preferably to appliances capable of functioning in a humid atmosphere or of being in contact with moisture, such as pressing irons in general whether of the steam type or dry type (typically used with a damp cloth), or even appliances such as fryers or boiling, steaming, or grilling devices of all types.

In the preferred uses to which reference has been made above, the heating structure is integrated in an advantageous manner into a pressing iron of the vapor type or the dry type, and the present invention concerns equally directly a pressing iron provided with such a heating structure.

In the specific technical field of pressing irons, it is already known, as disclosed for example in British Patent No. A-1,085,784, to form a sole plate comprising a metal sheet serving to diffuse the heat produced by a resistive component and to be brought in contact with a textile article to be pressed. The resistive component is electrically isolated with the aid of a polymerized plastic such as a silicone resin, an epoxy resin or a polyimide, consisting of upper and lower isolating coating layers. The assembly of the resistive component and these two electric isolation layers is bonded, or cemented, onto a metal sheet through the intermediary of an adhesive layer. It is equally possible to employ two supplementary protective layers consisting, for example, of sheets of mica or micanite, in cases where the working temperature of the iron is high and capable of having a negative influence on the attachment of the initial electrical isolating layers. Such a sole plate is conventional in the prior art and possesses a number of drawbacks.

In the first place, it has already been noted that the bonding provided by the adhesive layer at high temperature is insufficient, and a partial or total detachment of the resistive element can occur after a relatively short period of utilization compared with the overall life expectancy of other components of the pressing iron.

It must equally be noted that such a technique is completely ill-adapted to the fabrication of sole plates particularly for steam irons, for which the operating requirements, and particularly the thermal conditions experienced by the sole plate, are highly varied and demanding.

In effect, the sole plate in this case must perform a double thermal function, since it is a matter, on the one hand, of vaporizing water adjacent the upper surface of the sole plate and, on the other hand, of effecting the pressing action itself by means of the lower surface of that sole plate.

It has already been suggested to employ, for steam irons, sole plates which have what is called a sandwich structure, limited outwardly by two heat diffusing elements, such as metal plates, between which are disposed a plurality of intermediate layers, each superposed to other layers starting from a central element constituting the resistive component. Such a sandwich structure is shown, for example, in French Application A-2,641,291, in which the intermediate layers between the central resistive component and the external metal sheets are constituted by two brazed alloy colaminated layers, the resistive component being separated from the latter sheets by an electrically isolating layer constituted of sheets of micanite. Resort to a sandwich structure of this type could be considered as being generally satisfactory with respect to high temperature bonding properties of the sole plate. However, it is in order to note that the fabrication of such a sandwich structure requires substantial and burdensome investments in plant and equipment due, inter alia, to the need for a brazing furnace. Thus, such a technique requires that the home appliance incorporate a relatively costly element.

SUMMARY OF THE INVENTION

It is accordingly an object of the present invention to eliminate the various drawbacks noted above, and to provide a high temperature heating member having a sandwich structure capable of performing at least one and preferably two different thermal functions, capable of improving the dissipation of heat from the resistive component without having a negative long term influence on the bonding of the internal structure of the heating member regardless of the thermal conditions experienced, and capable of achieving these results with a reduced fabrication cost.

An additional object of the invention is to provide a heating structure which is fabricated in a particularly simple manner and which has improved airtightness, liquid tightness and vapor tightness.

Another object of the invention is to provide a heating structure having an improved long term integrity of the cohesive bond between different constituent layers, despite substantial thermal stresses.

Yet another object of the invention is to provide an electrical home appliance comprising such a heating structure, and in particular a steam iron capable of being fabricated at reduced cost, while having good thermal dissipation properties, a durable internal cohesion of the elements of the sole plate, and good fluid tightness of the sole plate.

The above and other objects according to the invention are achieved with a heating structure, particularly for an electrical home appliance, such as a pressing iron or a cooking appliance such as a fryer for example, including a sandwich structure which is delimited at the outside by two rigid elements at least one of which forms a heating plate, the rigid elements being capable of diffusing the heat produced by a heating unit composed of a resistive component covered with an electrical isolation, the unit being secured to the rigid elements by the intermediary of at least one connecting means, wherein:

the heating unit is delimited by two electrically isolating coating or covering sheets between which extends a first layer of thermoplastic resin into which is inserted or embedded the resistive component, the thermoplastic resin layer adhering to the electrically isolating coating sheets;

the connection means are constituted by a second layer of thermoplastic resin, extending between the heating plate and the associated electrically isolating coating sheet and adhering to the plate and the sheet.

Other features and advantages of the invention will be described below in greater detail, with reference to the attached drawings which are to be considered to illustrate non-limiting examples.

DESCRIPTION OF THE PREFERRED EMBODIMENTS

Figure 2:
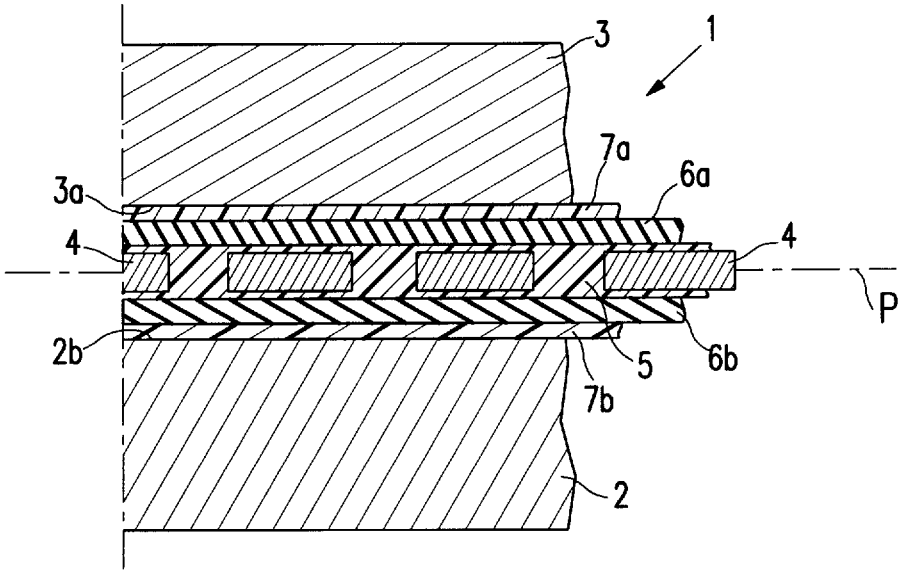
FIG. 2 is a view similar to that of FIG. 1 showing the heating structure in its final state according to the invention.

Referring, firstly, to FIG. 2, a heating structure 1 according to the invention is of the type capable of producing and withstanding high temperatures and is constituted by a sandwich structure formed by the stacking of a plurality of layers limited externally by two heat diffusing elements composed, respectively, of a lower plate 2 and an upper plate 3.

It has been found that the temperature which can be achieved with such a structure exceeds 180° C. and preferably is close to 300° C. The plates 2 and 3 can be made of any rigid or flexible material presently employed to perform a heat diffusion function. Such materials can include stainless steel, mild steel, ceramics, vitrocrystalline materials and glass, for example, as well as aluminum, the latter material being particularly advantageous when the heating structure is to be used in a pressing iron. Plates 2 and 3 can also both be made of the same material or can be made of respectively different materials depending on the type of utilization envisioned. In addition, plates 2 and 3 can both have the same thickness or can have different thicknesses.

Figure 6:
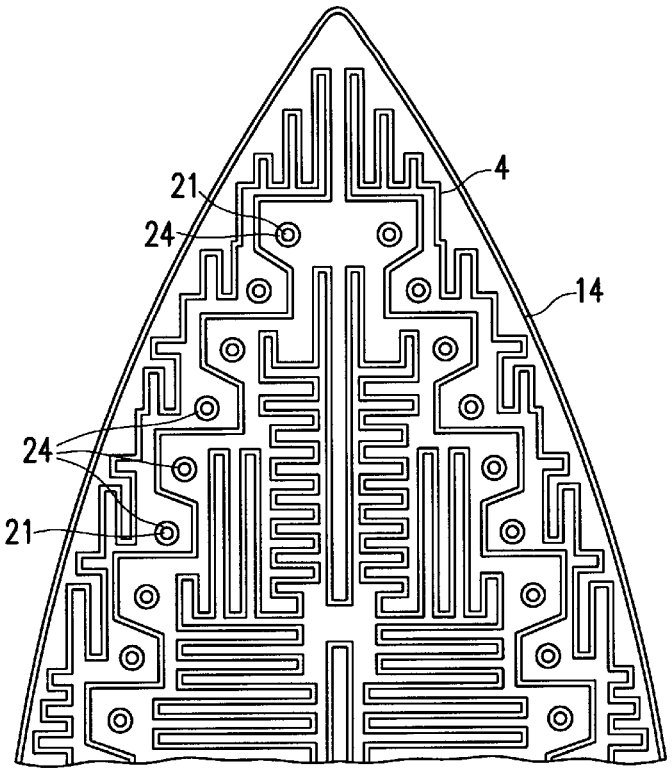
FIG. 6 is a detail, plan view showing the pattern of a resistive heating component of the heating structure according to the invention.

The heating structure includes a heating unit in the form of a resistive component 4 constituted by one or several strips extending along a defined path and forming a series of loops or bends, i.e. the strips follow serpentine or meandering paths, one example of which is shown in FIG. 6. Resistive component 4 is sandwiched between plates 2 and 3. Preferably, resistive component 4 and the loops which constitute it are centered on a longitudinal plane of symmetry, P, of heating structure 1. Resistive component 4 can be made of any material currently utilized for heating element strips, such as nickel-chrome alloys or even, preferably, a material based on a constantan alloy. The cross section and length of resistive component 4 varies according to the desired electrical power. Preferably, its thickness, perpendicular to plane P, will be of the order of 50 $\mu$ and can vary between 20 and 100 $\mu$, for example. For a given thickness and resistive component material resistivity, the length and width of the strip or strips will be determined, according to principles well known in the art, on the basis of the rate at which heat is to be generated.

The resistive component 4 is inserted, or embedded, in a first layer 5 of thermoplastic resin, which layer covers at least the upper and lower parts of resistive component 4. In a conventional manner, resistive component 4 is provided with an electrically isolating, or electrical insulation, covering constituted by an upper sheet 6*a* and a lower sheet 6*b*, each sheet adhering to a respective surface of the first layer 5 of thermoplastic resin and consequently delimiting the heating unit. The material utilized for the electrically isolating covering sheets can be selected from among any conventional compositions utilized in the art, taking into account the thermal stresses that will be imposed on the heating structure. In the context of use of the heating structure for an electrical home appliance, such as a pressing iron, it is particularly advantageous to utilize a material of the polyimide type for sheets 6*a* and 6*b*.

The connection, or bonding, means assuring adherence between, on the one hand, the respective opposed faces 2*b* and 3*a* of the upper and lower plates 2 and 3 and, on the other hand, the upper and lower faces of the sheets 6*a* and 6*b* comprises at least an upper layer 7*a* of thermoplastic resin and a lower layer 7*b* of thermoplastic resin.

According to preferred embodiments of the invention, the respective bonds, or connections, between plate 2 and layer 6*b* and between plate 3 and layer 6*a* are each constituted by a single layer of thermoplastic resin.

In order to achieve a constant level of heat dissipation across the thickness of the sandwich structure, the thermoplastic material utilized for each of the thermoplastic resin layers 5, 7*a* and 7*b* will preferably have the same composition in all three layers. It is, however, possible to give the three layers of thermoplastic material respectively different compositions, depending on the thermal stresses to which the heating structure 1 will be subjected. Alternatively, layer 5 can be made of a thermoplastic resin different from that employed for layers 7*a* and 7*b*. Advantageously, at least layers 7*a* and 7*b* will be made of the same material, and preferably layer 5 will also be made of the same material.

The choice of thermoplastic resin depends obviously on the thermal stresses to be experienced by the heating structure and in the context of a specific application to home appliance articles and in particular to steam irons, it would be preferable to select PFA (perfluoroalkoxy) or PEEK (polyetheretherketone) for each of the three thermoplastic resin layers. It should be understood that, depending on the thermal stresses which are to be experienced by the heating structure for performing the intended function, other thermoplastic materials can be employed, such as PTFE (polytetrafluorethylen) or even FEP (tetrafluorethylene hexafluoropropylene, according to the nomenclature employed in the reference work Editions WEKA, Vol. 1), for example.

Figure 2A:
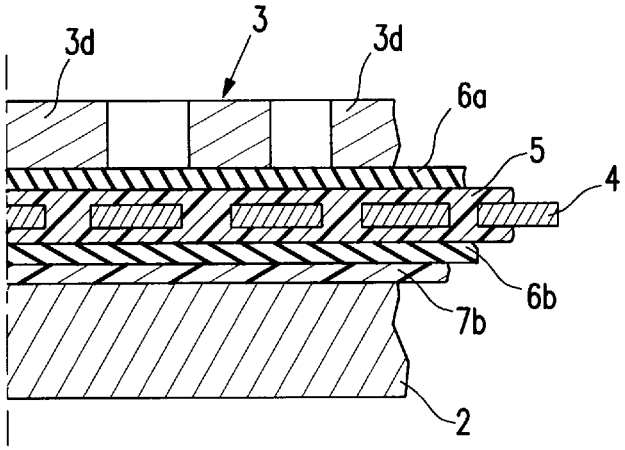
FIG. 2*a* is a view similar to that of FIG. 1 showing a simplified variation of the heating structure of FIG. 2.

It is also possible to simplify heating structure 1 according to the invention by eliminating, as shown for example in FIG. 2*a*, one of the layers of thermoplastic resin, such as the upper layer 7*a*. In such an alternative embodiment, only the lower plate 2 performs a specific thermal diffusion function, while the rigid upper plate 3 which delimits the upper part of heating structure 1 principally performs a mechanical function of stiffening and secondarily a thermal diffusion function. In FIG. 2*a*, rigid element 3 rests directly on the upper electrically isolating coating sheet 6*a* and can be constituted by a series of strips 3*d* which are spaced apart from one another.

Figure 7:
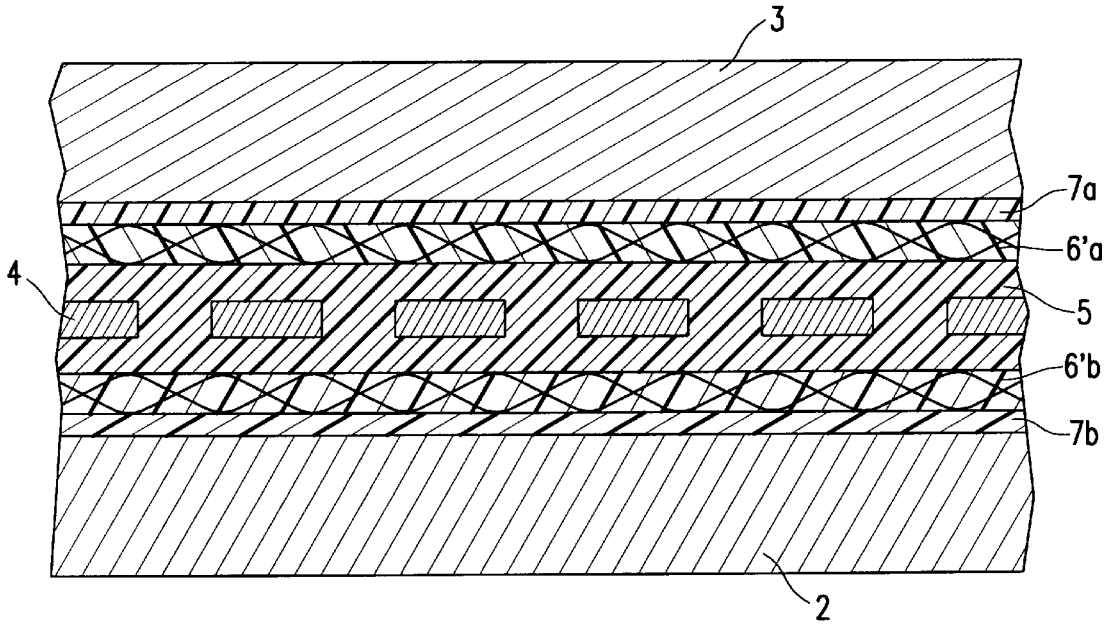
FIG. 7 is a cross-sectional detail view of another embodiment of the heating structure according to the invention.

According to another alternative embodiment, as shown in FIG. 7, the or each electrically isolating coating sheet comprises an upper fabric sheet 6'*a* and a lower fabric sheet 6'*b*. The body of each fabric sheet is impregnated, possibly partially, with thermoplastic resin from an adjacent one or ones of layers 5, 7*a* and 7*b*. Partial impregnation of each sheet 6'*a* and 6'*a* advantageously leaves the center of the fabric mesh thereof free of thermoplastic material, so that electrical isolation, or insulation, is achieved conjointly by the thermoplastic resin and the fabric.

In the example shown in FIG. 7, the three thermoplastic resin layers are each advantageously constituted by a layer of PEEK and the sheets 6'*a* and 6'*b* are preferably woven glass sheets which are partially filled with the thermoplastic resin. The woven sheets 6'*a* and 6'*b* also perform a mechanical function of a chassis or framework in the heating structure, assuring, with the thermoplastic resin, a good electrical isolation in the event of overheating of the strips of resistive component 4. The presence of a sheet of woven glass also facilitates fabrication of the sandwich structure by avoiding the effect of retraction or shrinkage of the thermoplastic resin layers, which has a positive influence on the planarity of the final product. The thickness of thermoplastic resin layers 7*a* and 7*b*, constituting the bonding means between each of plates 2 and 3 and the heating unit, is preferably less than that of each fabric sheet 6'*a* and 6'*b*. Advantageously, the sum of the thicknesses of the thermoplastic resin layers 5, 7*a* and 7*b* is equal to or greater than two times the thickness of each fabric sheet 6'*a*, 6'*b*. The sum of the thicknesses of the resin layers 5, 7*a* and 7*b* is preferably about 0.1 mm.

The heating structure according to the invention can be fabricated according to a procedure in which the resistive component is formed from a sheet of a suitable metal by any means known in the art and particularly by chemical cutting, or etching. Obviously, the resistive component can also be obtained by mechanical cutting or by silk-screen deposition of a resistive paste.

Figure 1:
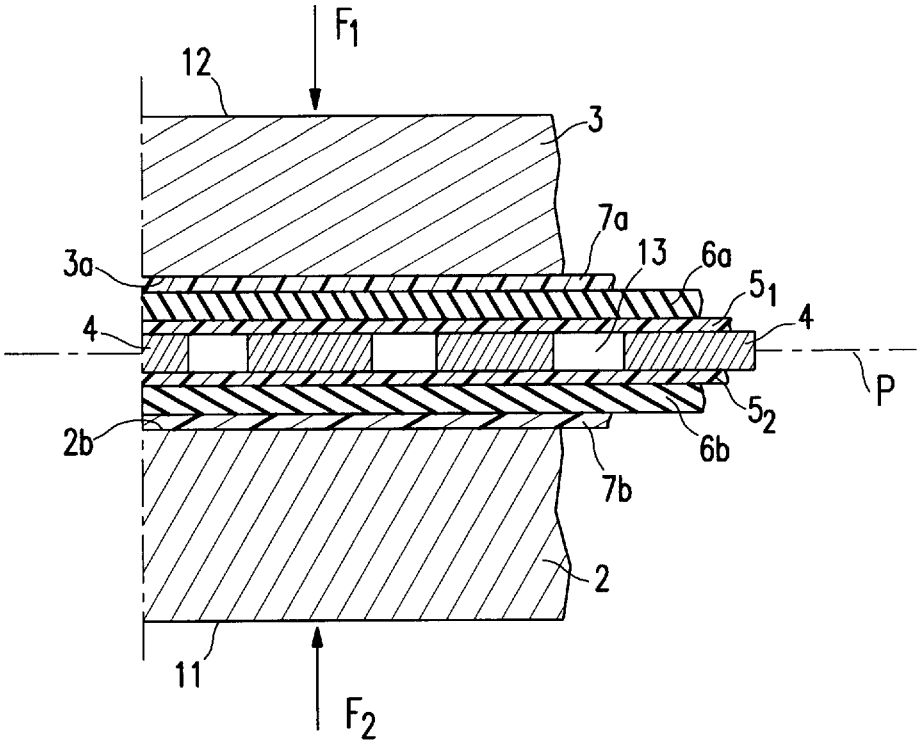
FIG. 1 is a cross-sectional view illustrating a heating structure according to the invention, in an intermediate fabrication stage prior to the performance of pressing and heating operations which lead to the finished article.

Parallel with the production of resistive component 4, the process for fabricating heating structure 1 includes a step of precoating each of the electrically isolating sheets 6*a*, 6*b* on each of their two faces with respective layers of thermoplastic resin, as shown in FIG. 1. According to the illustration presented in FIG. 1, the upper covering sheet 6*a* is precoated on its upper face with a thermoplastic resin layer 7*a* and on its lower face with another thermoplastic resin layer $\mathbf{5}_1$. The lower covering sheet 6*b* is in the same manner covered on its lower face with a thermoplastic resin 7*b* and on its upper face with another layer of thermoplastic resin $\mathbf{5}_2$. The coating with thermoplastic resin layers can be effectuated by any known means, and for example by spraying or atomizing. The resin layers $\mathbf{5}_1$ and $\mathbf{5}_2$ are intended to adhere together in the region of resistive component 4 and can present, for this purpose, overall individual thicknesses less than those of the upper and lower thermoplastic resin layers 7*a* and 7*b* which are intended to be adhered onto faces 2*b* and 3*a* of heat diffusing elements 2 and 3, respectively. Advantageously, the metal sheet constituting resistive component 4 is colaminated, before chemical cutting, or etching, onto one of the thermoplastic resin layers $\mathbf{5}_1$, $\mathbf{5}_2$ or on one of the electrically isolating sheets.

The next fabrication step consists in disposing at least one resistive component 4 between the two electrically isolating cover sheets 6*a*, 6*b*, each of which cover sheets was preliminarily coated on each of its two faces by thermoplastic resin layers, as described above.

The assembly of the various layers is completed by the superposition on each of the exposed faces of thermoplastic resin layers 7*a* and 7*b* of a respective one of the heat diffusing elements, or plates, 2 and 3, as illustrated in FIG. 1. These heat diffusing elements can consist of different materials known to those skilled in the art, such as laminated aluminum, stainless steel, steel coated with another metal by colamination (mild steel plus stainless steel) or by coating or deposition, zinc-coated steel, for example. It is also possible to utilize molded materials of synthetic resin or even enameled steel plates.

After having superposed the various layers, sheets and diffusing elements in the order and according to the structure shown in FIG. 1, the stacked assembly is conducted to a pressing unit (not shown in the drawings) where pressing means act on the external faces 11 and 12, respectively, of the lower and upper plates 2 and 3, resin layers 7*a*, 7*b*, $\mathbf{5}_1$ and $\mathbf{5}_2$ and resistive component 4 with isolating covering sheets 6*a* and 6*b*, by applying opposed compression forces $F_1$ and $F_2$.

During the course of the pressing operation, and in a synchronous manner, the totality of the sandwich structure is equally heated to a temperature at least equal to the melting temperature of the thermoplastic resin utilized, taking into account the effects of pressure on the thermoplastic resin, in a manner to effect transformation of the resin from its initial solid state to its liquid state. The heating means employed could be conventional and could effect heating by vibrations, which may be ultrasonic, for example, in order to avoid generalized heating of the structure being fabricated. In the context of the utilization of a thermoplastic resin such as PFA, the heating temperature should be such that the resin is brought to a temperature comprised substantially between 300° and 310° C.

As a result of the combined action of pressing and melting of the various thermoplastic resin layers 7*a*, 7*b*, $\mathbf{5}_1$ and $\mathbf{5}_2$, one obtains adherence and a sealing amongst the various constituents of the sandwich structure. The combined action of the pressing and the increased temperature permits in particular an effective attachment of the thermoplastic resin layers 7*a* and 7*b* to plates 2 and 3 and sheets 6*a* and 6*b*, as well as a diffusion and then a fusing of the two resin layers $\mathbf{5}_1$ and $\mathbf{5}_2$, around the various paths or strips constituting resistive component 4 in order to constitute the first thermoplastic resin layer 5 shown in FIG. 2. Depending on the relative thicknesses of the resistive components 4 and the initial resin layers $\mathbf{5}_1$ and $\mathbf{5}_2$, the resistive component 4 is more or less embedded in the first thermoplastic resin layer 5. Thus, interstitial spaces 13 present between the various branches of the circuit formed by resistive component 4 before the steps of pressing and temperature increase can be more or less filled by the thermoplastic resin layer 5. In all of the cases, it was noted that even if the interstitial spaces 13 were not completely filled, this did not have any noticeable adverse affect on the dielectric characteristics of the heating structure, and that the first thermoplastic resin layer 5 adhered sufficiently to the resistive component 4, even if there was only partial embedding of component 4 in layer 5.

Consequently, it is not necessary to adjust the quantity of thermoplastic material precisely in order to effectuate a complete embedding of the branches of the strips constituting resistive component 4.

In the preferred embodiment envisioned, which is that of steam irons, the thickness of each of the thermoplastic resin layers 7*a*, 7*b*, $\mathbf{5}_1$ and $\mathbf{5}_2$ will preferably be of the order of 12.5 $\mu$, while the thickness of the resistive component 4 itself, i.e., the resistive material forming that component, will be of the order of 50 $\mu$ (0.05 mm) and the thickness of the electrically isolating sheets 6*a* and 6*b* will be about 25 $\mu$ (0.025 mm). The ratio of the thickness of the layers of PFA to the thickness of resistive component 4 is of the order of 3/10 and can be considered to be the lower limit value for this ratio, below which the properties of adhesion, thermal dissipation and temperature resistance are compromised, if not insufficient.

Figure 3:
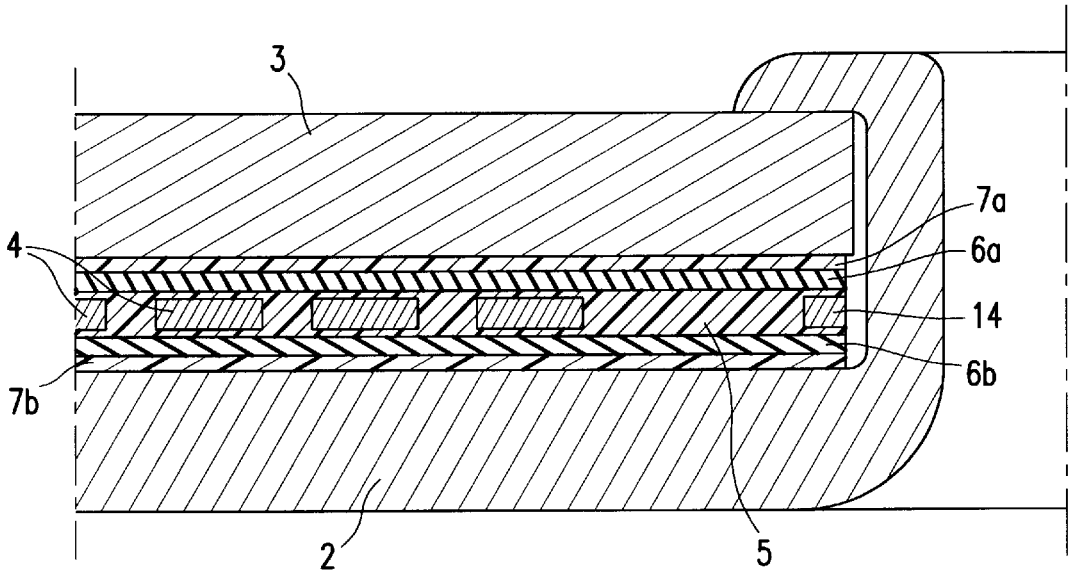
FIG. 3 is a cross-sectional detail view of a heating structure according to the invention provided with a peripheral sealing means.

In the case of an embodiment of a heating structure according to the invention with a first thermoplastic resin layer 5 obtained starting from two initial layers $\mathbf{5}_1$ and $\mathbf{5}_2$ having thicknesses which are reduced as much as possible within the limits of the relationship mentioned above, it is preferable, in order to maintain a heating structure having good dielectric properties, to provide a complementary peripheral sealing means at the level of and the border of resistive component 4 in a manner to eliminate all possibility of the passage of air, water vapor or liquid from the surrounding medium toward and to the interior of the resistive component and the exterior of the first resin layer 5. The effect of peripheral sealing can be obtained in a particularly simple and economic manner, as shown in FIGS. 3 and 6, by incorporation at the level of the strips constituting resistive component 4, and in the first resin layer 5, of a peripheral border, or edging, 14 formed by a chemically inert resistive strip which is not under tension, and is not connected to an electrical power source, and which encircles the totality of all of the active resistive strips. Such a border 14 is formed at the same time and according to the same principle as the active strips of resistive component 4 and prevents radial leakage of thermoplastic resin in the liquid state from layers $\mathbf{5}_1$ and $\mathbf{5}_2$ during the application of pressure to form the sandwich structure at the time the structure is in the form shown in FIG. 1, border 14 thus performing the function of a flow preventing abutment. Advantageously, plates 2 and 3, as well as the thermoplastic material will be selected to have substantially identical thermal expansion coefficients in order to retain a substantially constant temperature gradient throughout the thickness of the sandwich structure.

Also advantageously, plates 2 and 3 will be constituted by aluminum plates, resistive component 4 preferably being made of constantan while electrically isolating sheets 6*a* and 6*b* will be constituted by two layers of polyimide.

Figure 4:
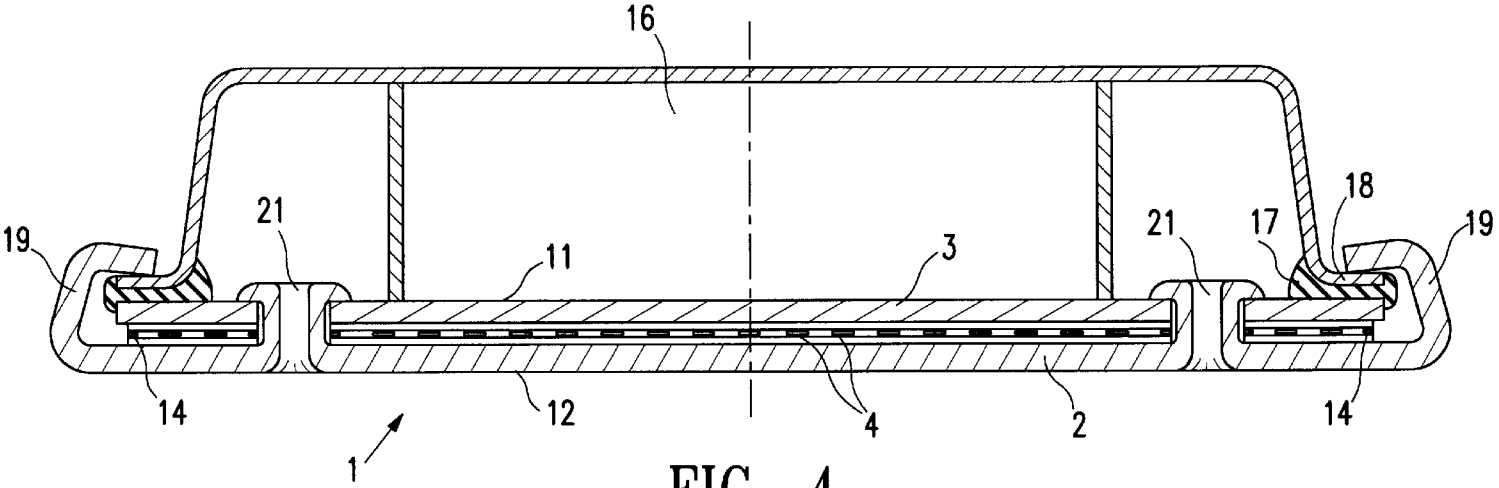
FIG. 4 is a cross-sectional view showing a heating structure according to the present invention installed in a steam iron.

FIG. 4 shows the incorporation of a heating structure 1 according to the invention into an electrical home appliance, and specifically a steam pressing iron, only the lower part of the pressing iron being illustrated. In one such embodiment plate 2 forms the ironing sole plate which is intended to come into contact with a textile article to be pressed, which article is not shown in the drawing. Plate 3 at least partially forms the lower wall of a vaporization chamber 16 which is thus disposed directly above heating structure 1. In such an arrangement, vapor tightness and the prevention of entry of fluids from the outside are assured, as described previously, by the installation of a resistive border 14, which is not electrically connected to any voltage source and which forms a peripheral joint at the extremity of layer 5. In a conventional manner, fluid tightness can be improved by the interposition of a further joint 17, for example made of silicone, between an outwardly laterally extending peripheral flange 18 of vaporization chamber 16 and plate 3. The assembly can be maintained in place under good fluid tightness conditions by folding or bending the peripheral edge 19 of plate 2 over flange 18 in a manner such that peripheral edge 19 performs a pinching or clamping action which holds the sole plate structure together and assures its peripheral fluid tightness. Thus, even if a failure should occur at some point in a bond between the components of heating structure 1, the gripping action performed by peripheral edge 19 will assure that the structural integrity of heating structure 1 is maintained, so that a long service life of the appliance can be assured, even if such a failure in a bond may diminish somewhat the energy conversion efficiency of the appliance.

Figure 5:
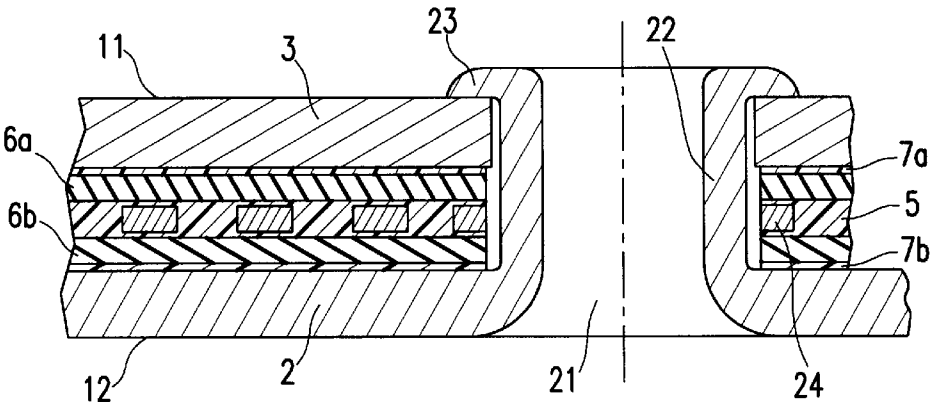
FIG. 5 is a cross-sectional detail view of a portion of the structure of FIG. 4, illustrating a vapor outlet opening which forms a sealing connection with a heating structure, in accordance with the invention.

A steam iron provided with a heating structure according to the present invention will also be provided, as is known in the art, with an array of orifices, or outlet holes, 21 extending between chamber 16 and the external face 12 of plate 2 for the discharge of steam onto a textile article being pressed. Preferably, orifices 21 are created by subjecting plate 2 to a high temperature plastic deformation process, or an extrusion process, while the plate is at a high temperature in a manner to create orifices 21 having a cylindrical form. As shown in FIG. 5, each of orifices 21 has a wall which extends across the sole plate, or, heating structure 1 to open above the upper face 11 of plate 3. The various layers of the heating structure of the sole plate are thus further held together by shaping the free end of each orifice 21 in the manner of a rivet.

Specifically, each orifice 21 initially has the form of an extruded tubular member 22 with a diameter which is constant along its length. After plate 2 has been assembled with plate 3, resistive component 4, layer 5, electrically isolating sheets 6*a* and 6*b* and layers 7*a* and 7*b*, each tubular member 22 projects through a passage previously formed in the other elements of heating structure 1. At this time, the free end of each tubular member 22 can be bent over, or swaged in the manner of a rivet, to form a radially outwardly extending flange 23 which performs a clamping function between plates 2 and 3, which enhances heat exchange and which helps to prevent physical deformation of the heating structure. In addition, flange 23 of each tubular member 22 acts to isolate the layers between plates 2 and 3 from steam created in chamber 16. This fluid tightness in the region of orifices 21 is improved, as shown in FIGS. 5 and 6 by the incorporation in layer 5 of strips of electrically resistive elements 24 in the form of rings surrounding the region into which each of orifices 21 will extend.

The heating structure according to the invention thus provides, due to the presence of three thermoplastic resin layers, on the one hand good heat transmission properties between the various layers and, on the other hand equally a good resistance to mechanical and thermal shocks. Also, these advantages are achieved while maintaining good bonding properties between the different layers.

The achievement of such a heating structure that does not require an extensive, complex and burdensome industrial infrastructure and the cost of such a heating structure can, as a result, be substantially reduced. In the same manner, the dielectric properties of the heating structure can be obtained at the lowest cost, by limiting the quantities of thermoplastic utilized to form layer 5. It is equally to be noted that the heating structure according to the invention, and particularly a pressing iron comprising such a heating structure, presents remarkable fluid tightness properties which are obtained at minimum costs. In effect, fluid tightness is assured by avoiding the use of conventional sealing elements and instead using, as sealing means, strips of material having the same composition as resistive component 4.

Finally, one can note that the incorporation of a heating structure according to the invention in the pressing sole plate of a steam iron permits, due to the good thermal dissipation properties of the heating assembly, mounting of a vaporization chamber directly above the upper plate of the sandwich structure. There results therefrom a great simplification of the internal fashioning of the iron, which influences in a positive manner the cost of the fabrication plant.

The heating structure according to the invention is incorporated in a preferred manner in a steam iron, but it is obvious that its use can be extended to all types of pressing irons in general, and equally to culinary receptacles of the fryer type, appliances which perform a grilling function, or appliances which require the generation of steam, such as coffee makers or kettles, for example.

This application relates to subject matter disclosed in French Application number 9200970, filed on Jan. 24, 1992, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. In a heating structure for use in an appliance, the heating structure being a sandwich structure comprising: two rigid elements constituting external elements of the sandwich structure, with at least one of the rigid elements being a heating plate; a heating unit comprising an electrical resistance component disposed between the rigid elements for producing heat which is diffused through the rigid elements, said electrical resistance component having upper and lower parts and said heating unit further comprises a primary layer of thermoplastic resin material into which said electrical resistance component is embedded so that said primary layer covers said upper and lower parts of said electrical resistance component, said electrical insulation material is composed of first and second layers of electrical insulation material which enclose said electrical resistance component and said primary layer of thermoplastic resin material, and said primary layer of thermoplastic resin material adheres to said layers of electrical insulation material;

said bonding means comprises a second layer of thermoplastic resin material disposed between, and adhering to, said heating plate and said first layer of electrical insulation material, wherein said primary layer and said second layer are each of a material selected to cause said heating structure to be permanently bonded at temperatures exceeding 180° C.; and said electrical insulation material has a composition different from that of said thermoplastic resin material.

2. A heating structure as defined in claim 1, wherein the other one of said rigid elements is a second heating plate and said bonding means further comprise a third layer of thermoplastic resin material disposed between, and adhering to, said second heating plate and said second layer of electrical insulation material.

3. A heating structure as defined in claim 2, wherein said primary, second and third layers of thermoplastic resin material all have the same composition.

4. A heating structure as defined in claim 3, wherein the thermoplastic resin layer composition is one of PTFE, FEP, PFA or PEEK.

5. A heating structure as defined in claim 2, wherein said heating plates and said layers of thermoplastic resin material have substantially identical coefficients of thermal expansion.

6. A heating structure as defined in claim 1, wherein each of said rigid elements is made of aluminum and said electrical resistance component is made of constantan.

7. A heating structure as defined in claim 1, wherein said electrical insulation material is a polyimide.

8. A heating structure as defined in claim 1, wherein said first and second layers of electrical insulation material are each constituted by a sheet of a woven fabric impregnated with thermoplastic resin material from at least one of said layers of thermoplastic resin material.

9. A heating structure as defined in claim 8, wherein the woven fabric is a glass fabric.

10. A household electrical appliance comprising at least one heating structure as defined in claim 1.

11. In a heating structure for use in an appliance, the heating structure being a sandwich structure comprising: two rigid elements constituting external elements of the sandwich structure, with at least one of the rigid elements being a heating plate; a heating unit comprising an electrical resistance component disposed between the rigid elements for producing heat which is diffused through the rigid elements, and electrical insulation material covering the electrical resistance component; and bonding means securing the heating unit to the rigid elements, the improvement wherein:

said heating unit further comprises a primary layer of thermoplastic resin material into which said electrical resistance component is inserted, said electrical insulation material is composed of first and second layers of electrical insulation. material which enclose said electrical resistance component, and said primary layer of thermoplastic resin material adheres to said layers of electrical insulation material; and said bonding means comprises a second layer of thermoplastic resin material disposed between, and adhering to, said heating plate and said first layer of electrical insulation material, wherein said heating structure has a peripheral edge and said heating unit further comprises a peripheral sealing border strip composed of a chemically inert, electrically resistive material.

12. A household electrical appliance constituted by a steam iron comprising at least one heating structure, said heating structure being a sandwich structure comprising: two rigid elements constituting external elements of the sandwich structure, with at least one of the rigid elements being a heating plate; a heating unit comprising an electrical resistance component disposed between the rigid elements for producing heat which is diffused through the rigid elements, and electrical insulation material covering the electrical resistance component; and bonding means securing the heating unit to the rigid elements, the improvement wherein:

said heating unit further comprises a primary layer of thermoplastic resin material into which said electrical resistance component is inserted, said electrical insulation material is composed of first and second layers of electrical insulation material which enclose said electrical resistance component, and said primary layer of thermoplastic resin material adheres to said layers of electrical insulation material; and said bonding means comprises a second layer of thermoplastic resin material disposed between, and adhering to, said heating plate and said first layer of electrical insulation material, wherein one of said rigid elements constitutes a sole plate of said steam iron and the other one of said rigid elements forms at least one part of a bottom wall of a steam generating chamber of said steam iron.

13. An appliance as defined in claim 12, wherein said steam iron has a plurality of steam passages which extend through said heating structure and communicate with said steam generating chamber, said sole plate is constituted by that one of said rigid elements which is remote from said steam generating chamber, and said steam passages are constituted by portions of said sole plate.

14. An appliance as defined in claim 13, wherein said steam passages are tubular parts which are formed by hot plastic deformation and which project from said sole plate, and said tubular parts have free ends which are swaged in the manner of rivets to over said other one of said rigid elements and to clamp said rigid elements together, whereby said parts form additional bonding components for said heating structure.

15. An appliance as defined in claim 14, further comprising a chemically inert, electrically resistive sealing strip surrounding each said tubular part and forming a vapor tight joint between said steam generating chamber and material between said rigid elements.

16. Process for producing a heating structure for use in an appliance, the heating structure being a sandwich structure comprising: two rigid elements constituting external elements of the sandwich structure, with at least one of the rigid elements being a heating plate; a heating unit comprising an electrical resistance component disposed between the rigid elements for producing heat which is diffused through the rigid elements, and electrical insulation material covering the electrical resistance component; and bonding means securing the heating unit to the rigid elements, the heating unit further including a primary layer of thermoplastic resin material into which the electrical resistance component is inserted, the electrical insulation material being composed of first and second layers of electrical insulation material which enclose the electrical resistance component, the primary layer of thermoplastic resin material adhering to the layers of electrical insulation material, and the bonding means including a second layer of thermoplastic resin material disposed between, and adhering to, the heating plate and the first layer of electrical insulation material, said process comprising the steps of:

coating the electrical resistance component with thermoplastic resin layers and disposing the coated electrical resistance component between the first and second layers of electrical insulation material;

disposing the second layer of thermoplastic resin material on a respective layer of electrical insulation material and disposing the coated electrical resistance component, the first and second layers of electrical insulation material and the second layer of thermoplastic resin material between the rigid elements;

pressing the rigid elements toward one another while heating the region between the rigid elements to a temperature sufficient for softening the thermoplastic resin material, in order to compress the thermoplastic resin layers which coat the electrical resistance component to cause those layers to form the primary layer of thermoplastic resin material; and terminating the pressing operation and cooling the resulting structure.

17. Process as defined in claim 16 wherein the second layer of thermoplastic resin material is disposed on the first layer of electrical insulation material, and said step of disposing further comprises disposing a third layer of thermoplastic resin material on the second layer of electrical insulation material.

* * * * *